United States Patent [19]

Gibli

[11] Patent Number: 4,561,174

[45] Date of Patent: Dec. 31, 1985

[54] BRUSH ASSEMBLY TOOL

[76] Inventor: Elizor Gibli, 126 E. 23rd St., Huntington, N.Y. 11746

[21] Appl. No.: 701,778

[22] Filed: Feb. 14, 1985

[51] Int. Cl.[4] ..... H01R 43/06

[52] U.S. Cl. ..... 29/597; 29/598; 29/732

[58] Field of Search ..... 29/596–598, 29/732; 310/239–242, 245–247, 42, 71

[56] References Cited

U.S. PATENT DOCUMENTS 4,423,549 1/1984 King ..... 29/597

*Primary Examiner*—Carl E. Hall

*Attorney, Agent, or Firm*—Michael I. Kroll

[57] ABSTRACT

A brush assembly tool is provided and includes a cylindrical post and a brush retainer that will effectively preset four spring loaded brushes within a brush assembly housing so that a motor armature can be placed within the brush assembly housing.

4 Claims, 11 Drawing Figures

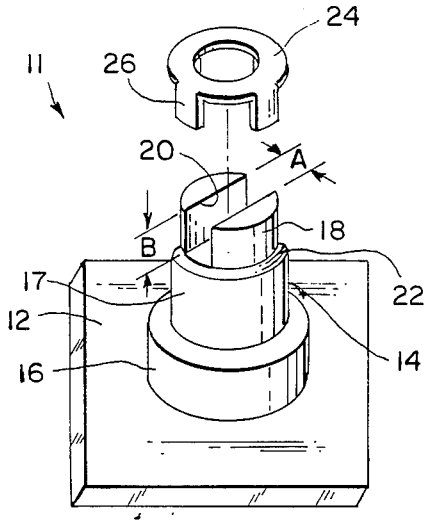

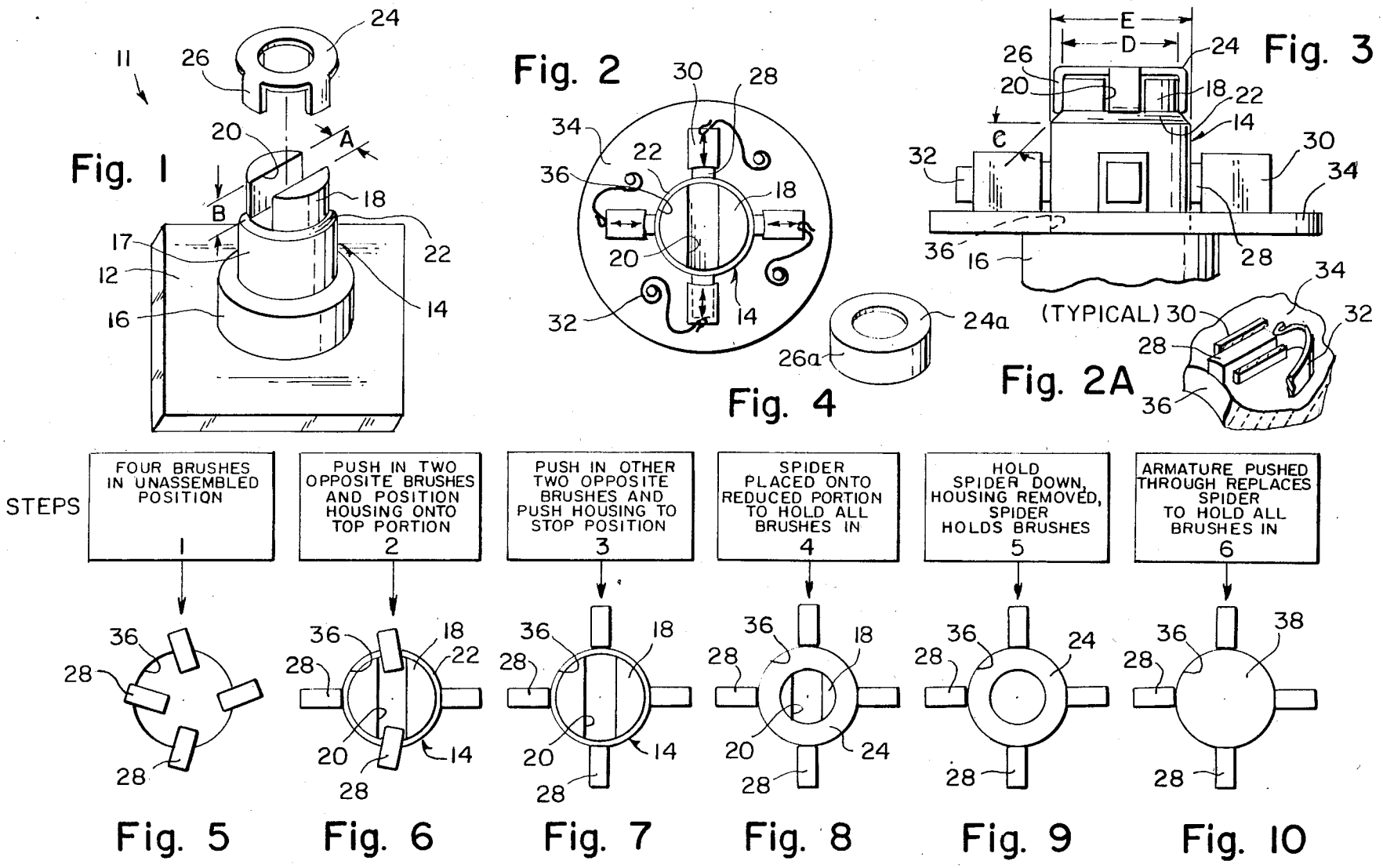
Fig. 1
Fig. 2
Fig. 3
Fig. 2A
(TYPICAL)
Fig. 4
STEPS
FOUR BRUSHES IN UNASSEMBLED POSITION 1
PUSH IN TWO OPPOSITE BRUSHES AND POSITION HOUSING ONTO TOP PORTION 2
PUSH IN OTHER TWO OPPOSITE BRUSHES AND PUSH HOUSING TO STOP POSITION 3
SPIDER PLACED ONTO REDUCED PORTION TO HOLD ALL BRUSHES IN 4
HOLD SPIDER DOWN, HOUSING REMOVED, SPIDER HOLDS BRUSHES 5
ARMATURE PUSHED THROUGH REPLACES SPIDER TO HOLD ALL BRUSHES IN 6
Fig. 5
Fig. 6
Fig. 7
Fig. 8
Fig. 9
Fig. 10

BRUSH ASSEMBLY TOOL

BACKGROUND OF THE INVENTION

1. Field of Invention

The instant invention relates generally to motors and more specifically it relates to the improvement in the method of assembling and presenting the brushes to a motor prior to the insertion of the armature within the brush assembly housing.

2. Description of the Prior Art

The present method by which the task of assembling motors that require brushes, undertaken by those who are in the field is as follows. The common practice is that a skilled operator uses some kind of pliers that will press the brushes within the brush housing as the operator forces the armative in between the brushes with hope that there is no damage done to either part. The process is very slow and any equipment heretofore produced has been very expensive.

SUMMARY OF THE INVENTION

A principle object of the present invention is to provide a brush assembly tool that will overcome the disadvantages of the prior art.

Another object is to provide a brush assembly tool that is fast and effective for presenting the spring loaded brushes within the brush housing so that the armature can be placed within.

An additional object is to provide a brush assembly tool that has no moving parts and requires no additional special tools.

A further object is to provide a brush assembly tool that is simple and easy to use.

A still further object is to provide a brush assembly tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the brush assembly tool with the spider brush retainer exploded above.

FIG. 2 is a top plan view of the brush assembly housing on the reduced top portion of the post body of the brush assembly tool with all the brushes pushed in and held.

FIG. 2A is an enlarged perspective view of a portion of the brush assembly housing with parts broken away of a typical brush, brush holder and brush spring thereon.

FIG. 3 is an elevational view of the brush assembly tool with parts broken away, such that the brush assembly housing is on the reduced top portion with all the brushes pushed in and held and the spider brush retainer in position on top.

FIG. 4 is a perspective view of a modified brush retainer having a continuous flange.

FIGS. 5 through 10 are diagrammatic top plan views of the brush assembly housing taken through various steps so that the armature of the motor can fit in between the brushes.

DETAILED DESCRIPTION OF THE PREFERRED EMBODIMENTS

Turning now descriptively to the drawings, in which similar reference characters denote similar elements throughout the several views, FIGS. 1 through 3 illustrates a brush assembly tool 11 for a brush assembly housing 34 having a central aperture 36 surrounded by four brush holders 30, four brushes 28 and four brush springs 32.

The brush assembly tool 11 consists of a platform 12 with a vertical cylindrical post 14 attached thereto. The vertical post 14 has three different diameter portions 16, 17 and 18.

The lower portion 16 has the largest diameter and acts as a stop for the brush assembly housing 34 when it is placed onto the post 14. The middle portion 17 has a diameter "E" that is equal to the diameter of an armature 38 (see FIG. 10) that is to be assembled to the brush assembly housing 34.

The upper portion 18 has a slot 20 that is machined cut into its end at a depth "B" equal to the depth of the brushes 28. The width "A" of the slot 20 is equal to or greater than the width of the brushes 28. The diameter "D" of the upper portion 18 is equal to the inside diameter of a spider brush retainer 24 that has four fingers 26. There is an angular lip 22 between the upper portion 18 and the middle portion 17 indicated by "C".

FIG. 4 shows a modified brush retainer **24*a* that can be substituted for the spider brush retainer 24. The brush retainer 24*a* has a continuous flange 26*a* instead of the four fingers 26 and will function in the same way as the spider brush retainer 24**.

FIGS. 5 through 10 illustrates the various steps that must be taken to use the brush assembly tool 11.

FIG. 5 shows step number 1. The four brushes 28 are in the aperture 36 in an unassembled position.

FIG. 6 shows step number 2. Two opposite brushes 28 not in alignment with the slot 20 are manually pushed in and held when the aperture 36 of the brush assembly housing is placed onto the top portion 18 and partly pushed down.

FIG. 7 shows step number 3. The other opposite brushes 28 in alignment with the slot 20 are manually pushed in and held when the brush assembly housing 34 is pushed all the way down to the lower portion 16.

FIG. 8 shows step number 4. The spider brush retainer 24 is placed upon the top portion 18 so that the fingers 26 are in proper position with all the brushes 28.

FIG. 9 shows step number 5. With the spider brush retainer 24 manually held down the brush assembly housing 34 is removed from the brush assembly tool 11. The four finger 26 of the spider brush retainer 24 holds the four brushes 28 in position.

FIG. 10 shows step number 6. The armature 38 is pushed through the central aperture 36 and removes and replaces the spider brush retainer 24 to hold the four brushes 28 in position. The spider brush retainer 24 is displaced by the armature 38 and can be used again.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. The method of properly positioning four spring loaded brushes within brush holders of a brush assembly housing having a central aperture prior to insertion of a motor armature through said central aperture of said brush assembly housing, said method comprises:

(a) pushing two opposite spring loaded brushes into proper position within said brush holders of said brush assembly housing;

(b) placing said central aperture of said brush assembly onto a reduced upper portion of a cylindrical post having a slot therein so that said two spring loaded brushes remain in proper position;

(c) pushing another two opposite spring loaded brushes that are in alignment with said slot into proper position within said brush holders of said brush assembly housing;

(d) pushing down said brush assembly housing until said brush assembly housing rests on a stop portion of said cylindrical post so that said four spring loaded brushes remain in proper position;

(e) placing a brush retainer upon said reduced upper portions of said cylindrical post;

(f) holding down said brush retainer when said brush assembly is removed from said cylindrical post so that said spring loaded brushes will apply pressure against said brush retainer and thus keep said brushes in proper position within said brush holders in said brush assembly housing; and (g) pushing said motor armature through said central aperture which removes and replaces said brush retainer to hold said four brushes in proper position.

2. A brush assembly tool for properly positioning four spring loaded brushes within brush holders of a brush assembly housing having a central aperture prior to insertion of a motor armature through said central aperture of said brush assembly housing, said tool comprises:

(a) a platform;

(b) a vertical cylindrical post attached to said platform, said post having a lower stop portion and a reduced upper portion with a slot therein, wherein two opposite spring loaded brushes are pushed into proper position within said brush holders of said brush assembly housing, said central aperture of said brush assembly housing placed onto said reduced upper portion of said cylindrical post with said two spring loaded brushes remaining in proper position, another two opposite spring loaded brushes that are in alignment with said slot are pushed into proper position within said brush holders of said brush assembly housing and said brush assembly housing pushed down until the brush assembly housing rests on said stop portion of said cylindrical post so that said four spring loaded brushes remain in proper position; and (c) a brush retainer to be placed upon said reduced upper portion of said cylindrical post, said brush retainer to be held down when said brush assembly is removed from said cylindrical post so that said spring loaded brushes will apply pressure against said brush retainer and thus keep said brushes in proper position within said brush holders in said brush assembly housing until said motor armature is pushed through said central aperture which removes and replaces said brush retainer to hold said four brushes in proper position.

3. A brush assembly tool as recited in claim 2, wherein said brush retainer is of a spider configuration and includes four downwardly extending fingers that will be in proper position with all said four brushes.

4. A brush assembly tool as recited in claim 2, wherein said brush retainer is of a cap configuration and includes a continuous downwardly extending flange that will always be in proper position with all said four brushes.

* * * * *